US006533635B1

(12) United States Patent
Chern

(10) Patent No.: US 6,533,635 B1
(45) Date of Patent: Mar. 18, 2003

(54) FOLDABLE HULA HOOP STRUCTURE

(76) Inventor: Ming-Dong Chern, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/087,162

(22) Filed: Feb. 27, 2002

(51) Int. Cl.[7] ..... A63H 33/02
(52) U.S. Cl. ..... 446/236; 482/131; 601/132
(58) Field of Search ..... 446/236, 219; 434/236; 601/132; 482/131

(56) References Cited

U.S. PATENT DOCUMENTS 5,108,340 A * 4/1992 Farrow ..... 446/242
5,997,449 A * 12/1999 Lee ..... 482/131
6,059,632 A * 5/2000 Sassak ..... 446/236
6,319,086 B1 * 11/2001 Shen ..... 446/236
6,379,288 B1 * 4/2002 Liu ..... 482/105

* cited by examiner

*Primary Examiner*—Derris H. Banks
*Assistant Examiner*—Dmitry Suhol

(57) ABSTRACT

A foldable hula hoop structure includes multiple arcuate connecting members combined with each other. Each of the arcuate connecting members includes two opposite flexible main bodies combined with each other. Each of the two opposite main bodies has a first end and a second end respectively provided with convex portions and mating concave portions, so that any two adjacent arcuate connecting members may be combined with each other by engagement of the convex portions with the mating concave portions. Each of the convex portions and the mating concave portions is formed with a through hole for passage of a first locking member which is locked with a second locking member, so that any two adjacent arcuate connecting members may be combined with each other by the first locking member and the second locking member.

10 Claims, 10 Drawing Sheets

FOLDABLE HULA HOOP STRUCTURE

BACKGROUND OF THE INVENTION

1. Field of the Invention

The present invention relates to a foldable hula hoop structure, and more particularly to a foldable hula hoop structure that may be folded to have a smaller volume easily and conveniently, thereby facilitating the user carrying and storing the foldable hula hoop structure.

2. Description of the Related Art

A conventional hula hoop structure in accordance with the prior art has a fixed configuration and has a larger volume, so that it cannot be folded and occupies larger space, thereby causing inconvenience to the user when carrying or storing the conventional hula hoop structure.

SUMMARY OF THE INVENTION

The present invention has arisen to mitigate and/or obviate the disadvantage of the conventional hula hoop structure.

The primary objective of the present invention is to provide a foldable hula hoop structure that may be folded to have a smaller volume easily and conveniently, thereby facilitating the user carrying and storing the foldable hula hoop structure.

In accordance with the present invention, there is provided a foldable hula hoop structure, comprising multiple arcuate connecting members combined with each other, wherein:

each of the arcuate connecting members includes two opposite flexible main bodies combined with each other, each of the two opposite main bodies has a first end and a second end respectively provided with convex portions and mating concave portions, so that any two adjacent arcuate connecting members may be combined with each other by engagement of the convex portions with the mating concave portions, each of the convex portions and the mating concave portions is formed with a through hole for passage of a first locking member which is locked with a second locking member, so that any two adjacent arcuate connecting members may be combined with each other by the first locking member and the second locking member.

Further benefits and advantages of the present invention will become apparent after a careful reading of the detailed description with appropriate reference to the accompanying drawings.

DETAILED DESCRIPTION OF THE INVENTION

Figure 1:
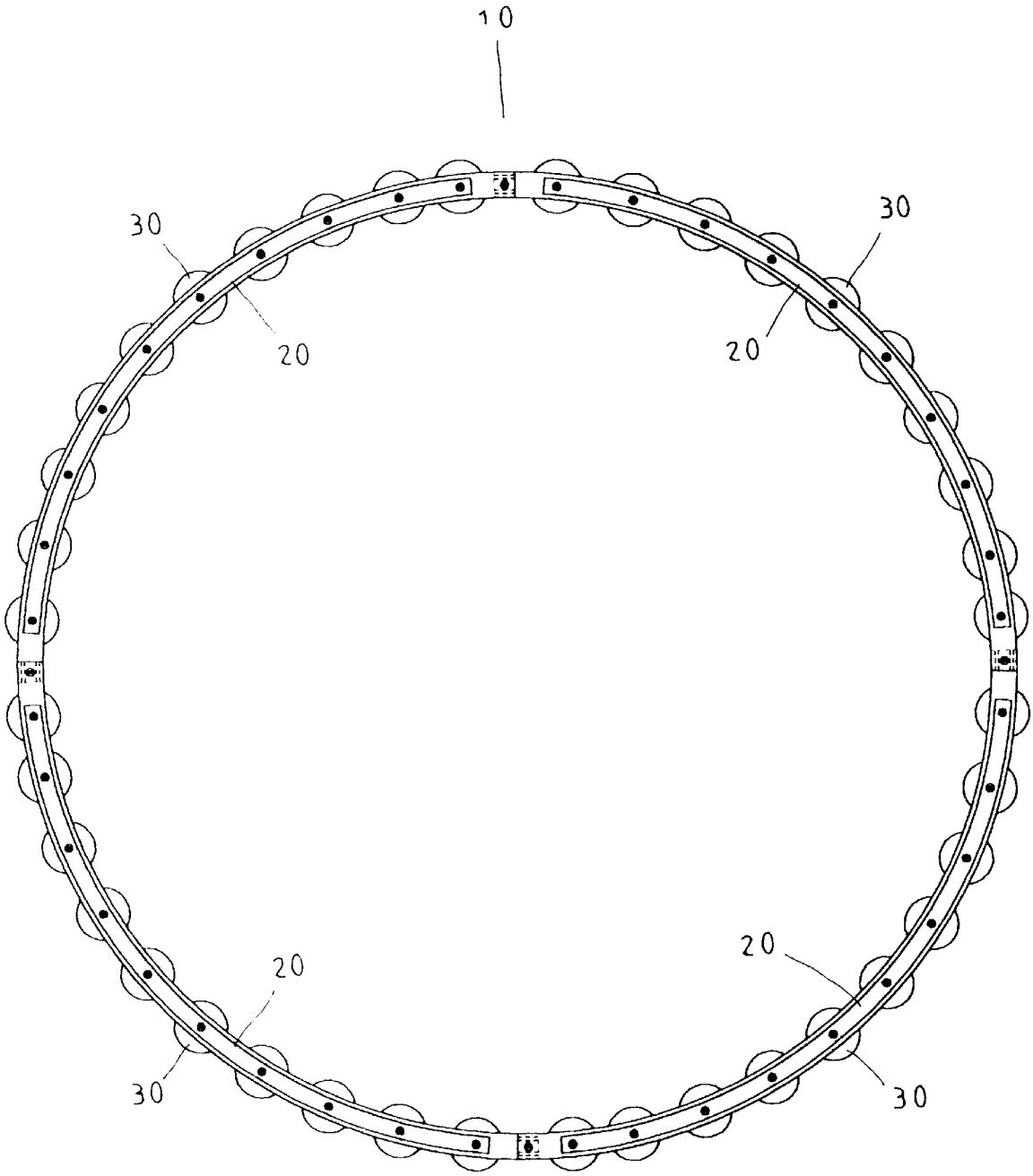
FIG. 1 is a top plan view of a foldable hula hoop structure in accordance with a first embodiment of the present invention.

Referring to the drawings and initially to FIGS. 1–6, a foldable hula hoop structure 10 in accordance with a first embodiment of the present invention comprises multiple arcuate connecting members 20 combined with each other.

Each of the arcuate connecting members 20 includes two opposite flexible main bodies 21 combined with each other. Each of the two opposite main bodies 21 has a first end and a second end respectively provided with convex portions 22 and mating concave portions 23, so that any two adjacent arcuate connecting members 20 may be combined with each other by engagement of the convex portions 22 with the mating concave portions 23.

Each of the convex portions 22 and the mating concave portions 23 is formed with a through hole 24 for passage of a first locking member "P" which is locked with a second locking member "Q", so that any two adjacent arcuate connecting members 20 may be combined with each other by the first locking member "P and the second locking member "Q". Preferably, an elastic restoring member 25 is mounted between the first locking member "P and the second locking member "Q".

Figure 2:
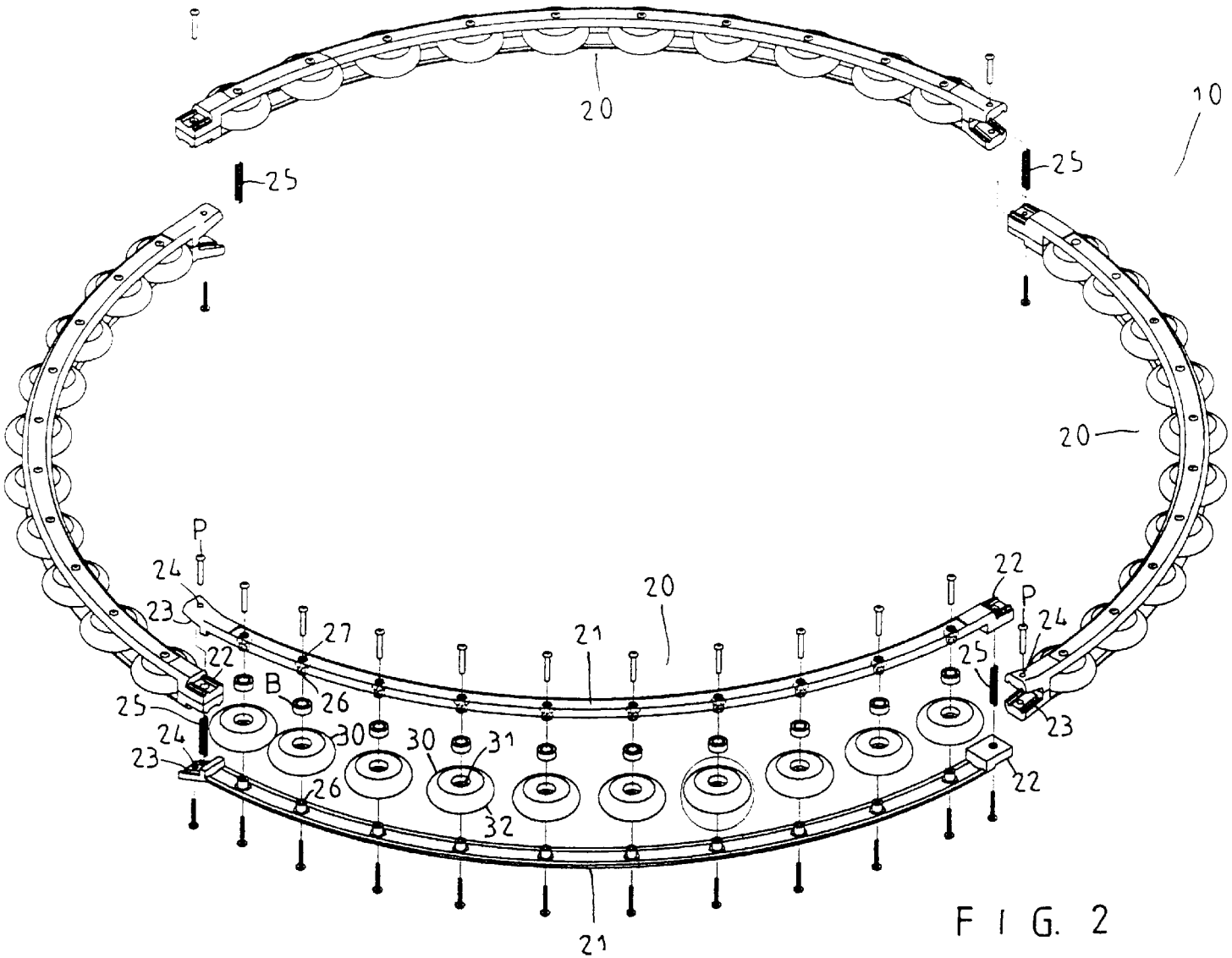
FIG. 2 is an exploded perspective view of a foldable hula hoop structure in accordance with a first embodiment of the present invention.
Figure 8:
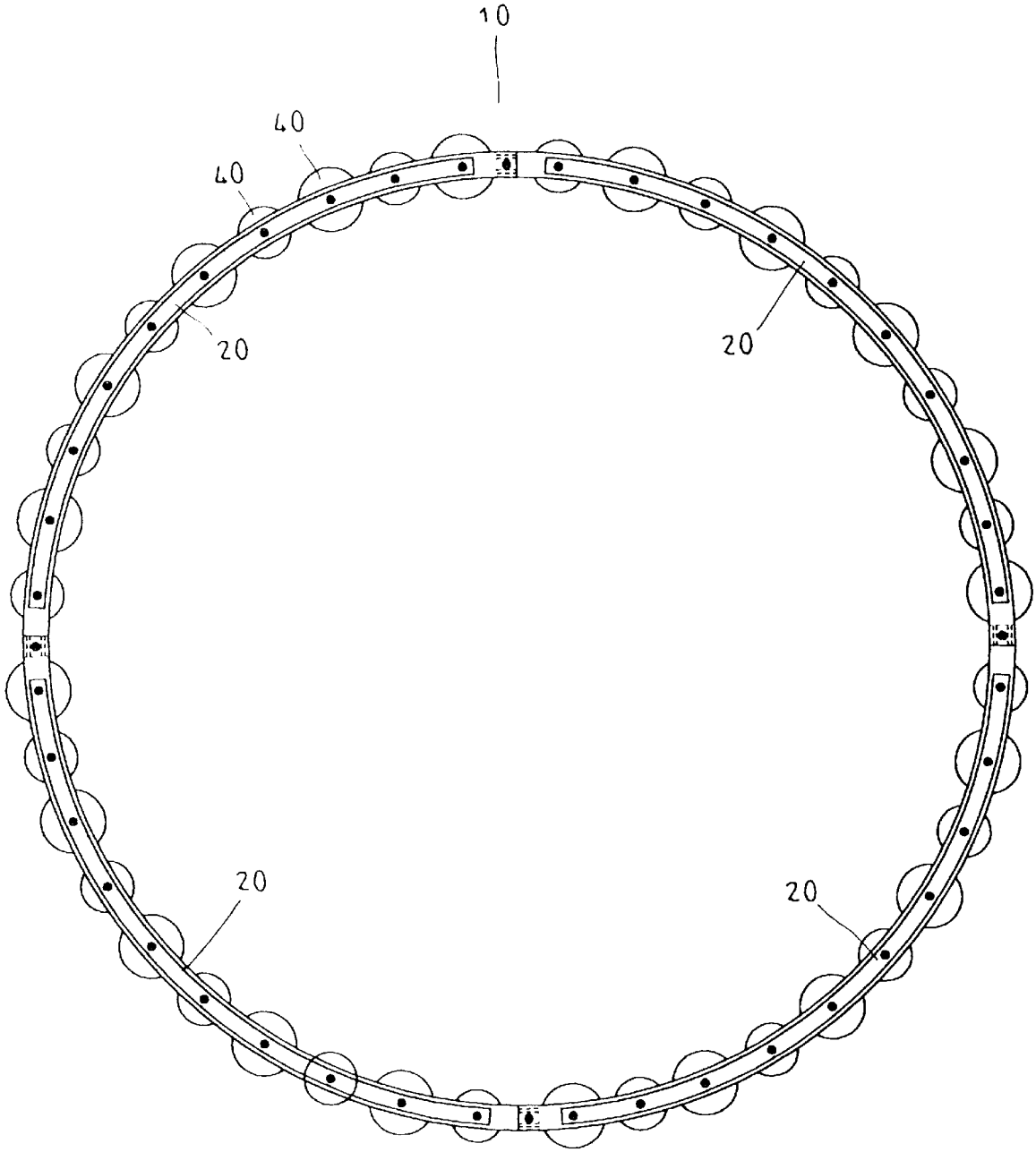
FIG. 8 is a schematic plan view of a foldable hula hoop structure in accordance with another embodiment of the present invention.

Each of the two opposite main bodies 21 is provided with multiple pivot portions 26 for pivoting multiple wheel-shaped rollers 30 as shown in FIG. 2 (or multiple spherical rollers 40 as shown in FIG. 8). Each of the pivot portions 26 is formed with a pivot hole 27 for passage of a first locking member "P" which is locked with a second locking member "Q", so that the multiple wheel-shaped rollers 30 may be pivotally mounted between the opposite main bodies 21. Preferably, a bearing "B" may be mounted between each of the pivot portions 26 and each of the multiple wheel-shaped rollers 30.

Figure 3:
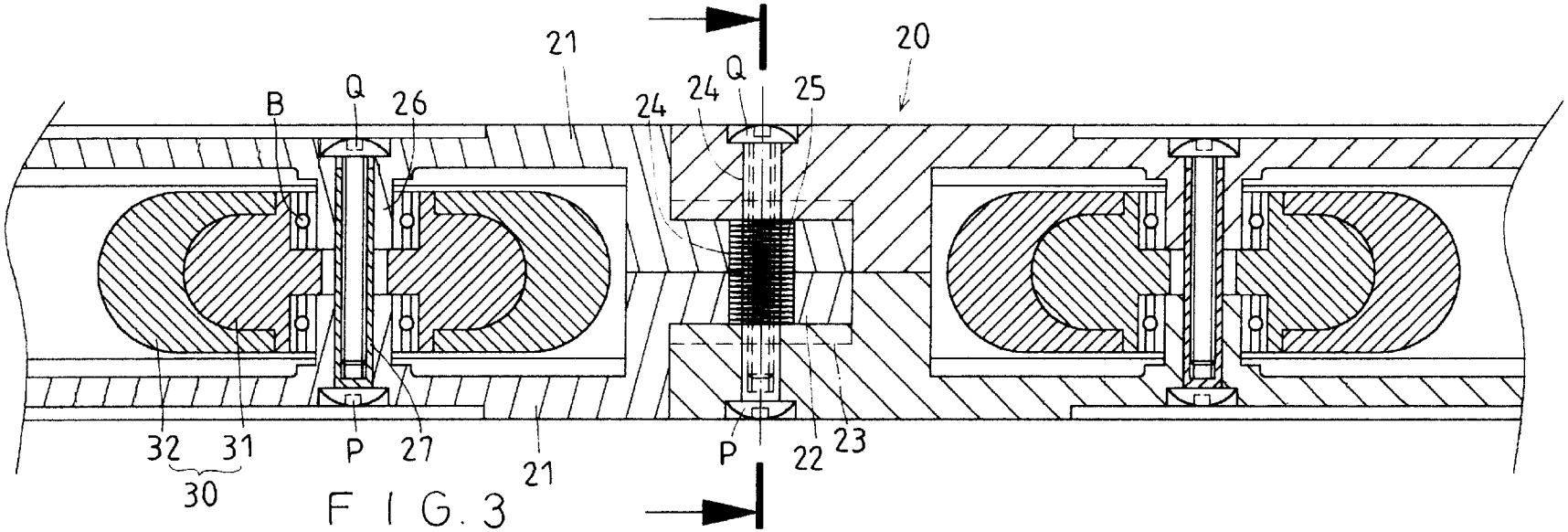
FIG. 3 is a side plan cross-sectional assembly view of a foldable hula hoop structure in accordance with a first embodiment of the present invention.
Figure 3A:
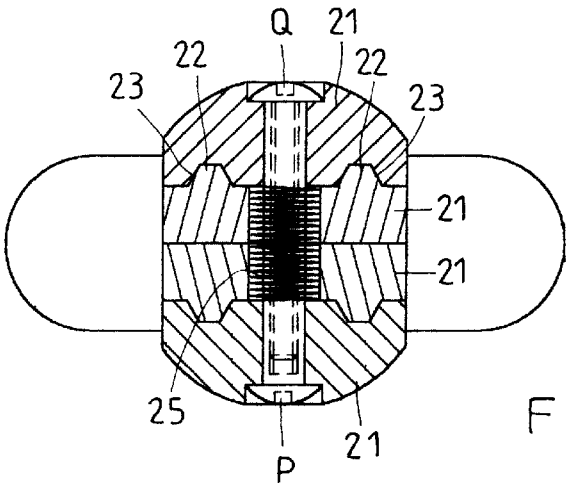
FIG. 3A is a cross-sectional view of the foldable hula hoop structure as shown in FIG. 3.

In assembly of the foldable hula hoop structure 10 of the present invention, referring to FIGS. 3 and 3A, the first locking member "P" is extended through the through hole 24 of each of the convex portions 22 and the mating concave portions 23 and through the elastic restoring member 25, and is locked by the second locking member "Q", so that any two adjacent arcuate connecting members 20 may be combined with each other by the first locking member "P and the second locking member "Q".

Figure 4:
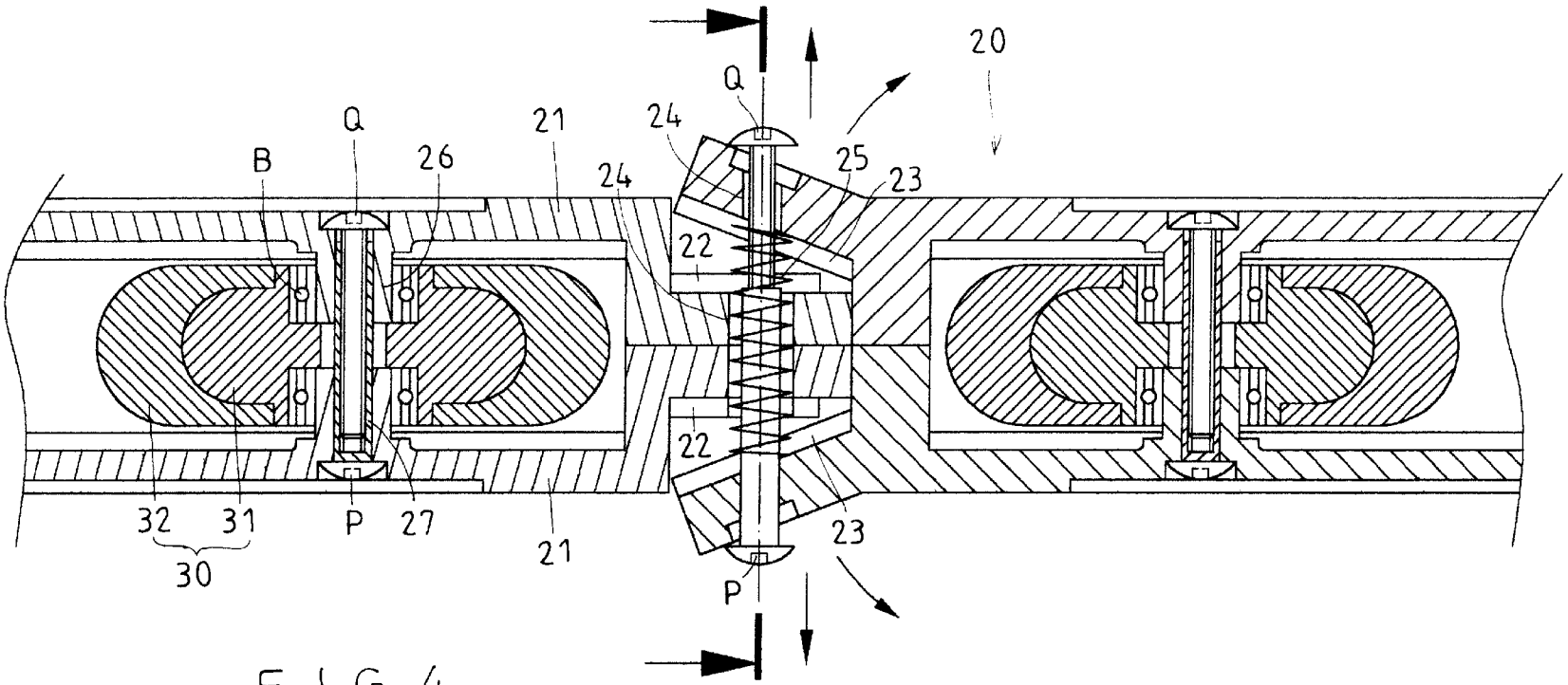
FIG. 4 is a schematic operational view of the foldable hula hoop structure as shown in FIG. 3.
Figure 4A:
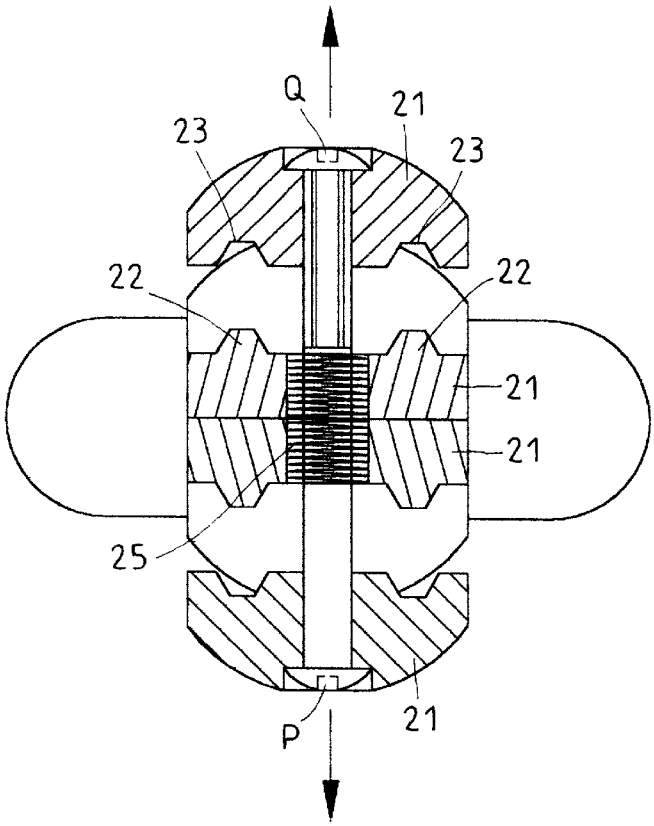
FIG. 4A is a cross-sectional view of the foldable hula hoop structure as shown in FIG. 4.

When the foldable hula hoop structure 10 of the present invention is released, referring to FIGS. 4 and 4A, the first locking member "P" may be unscrewed, so that the two main bodies 21 at the outer sides may be pushed outward by the restoring force of the elastic restoring member 25, thereby detaching the convex portions 22 from the mating concave portions 23.

Figure 5:
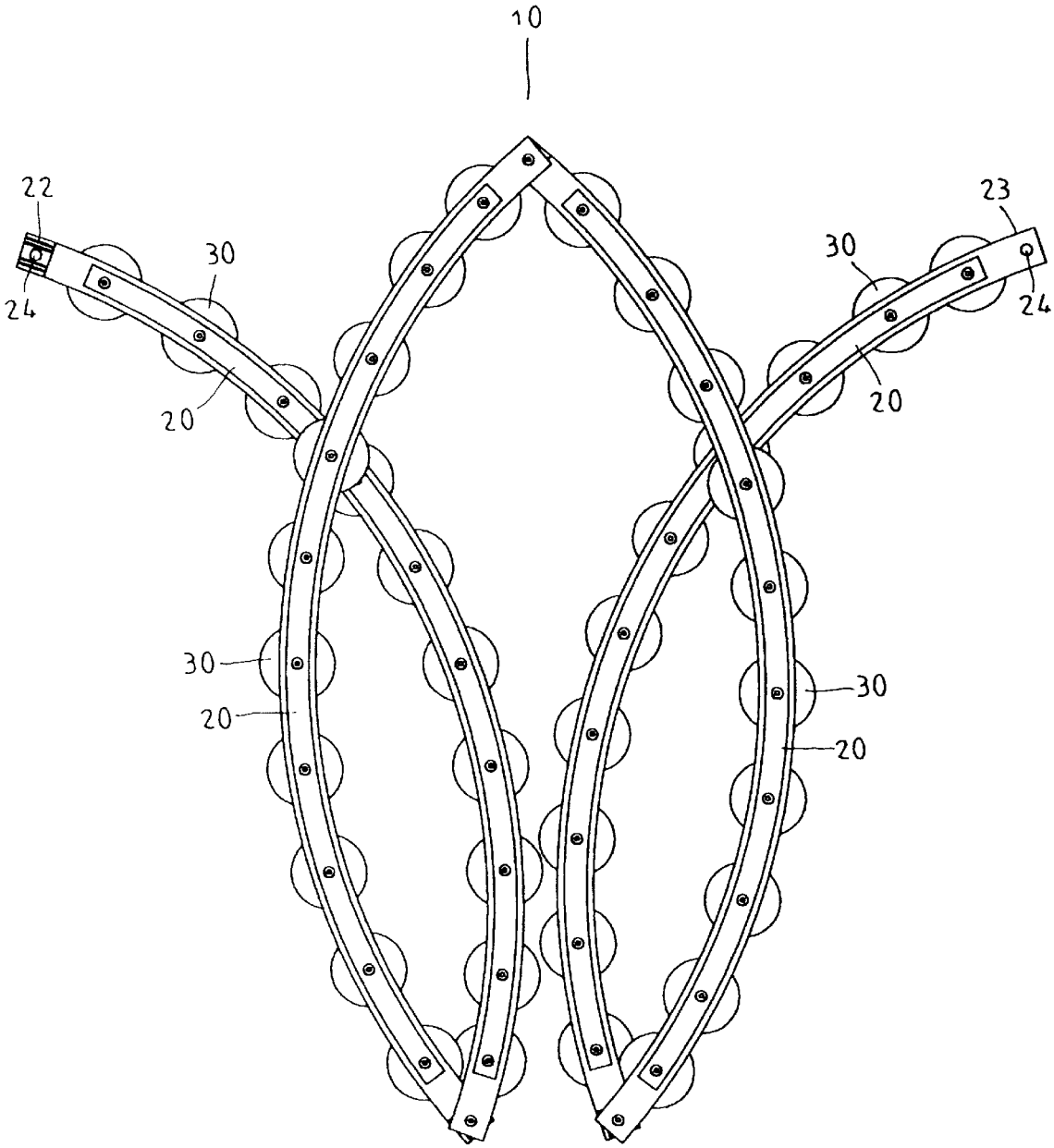
FIG. 5 is a schematic folding view of the foldable hula hoop structure as shown in FIG. 1.

When the foldable hula hoop structure 10 of the present invention is folded, referring to FIGS. 5, one set of the first locking member "P" and the second locking member "Q" is unscrewed, so that the circular foldable hula hoop structure 10 of the present invention may be folded into multiple sections of arcuate connecting members 20.

As shown in FIG. 3, each of the multiple wheel-shaped rollers 30 is made of a composite material, and includes a central portion 31 made of a harder material, and a peripheral portion 32 made of a softer material mounted around the central portion 31, thereby providing a softer feature to the human body when in contact with the user's body.

Figures 6, 6A:
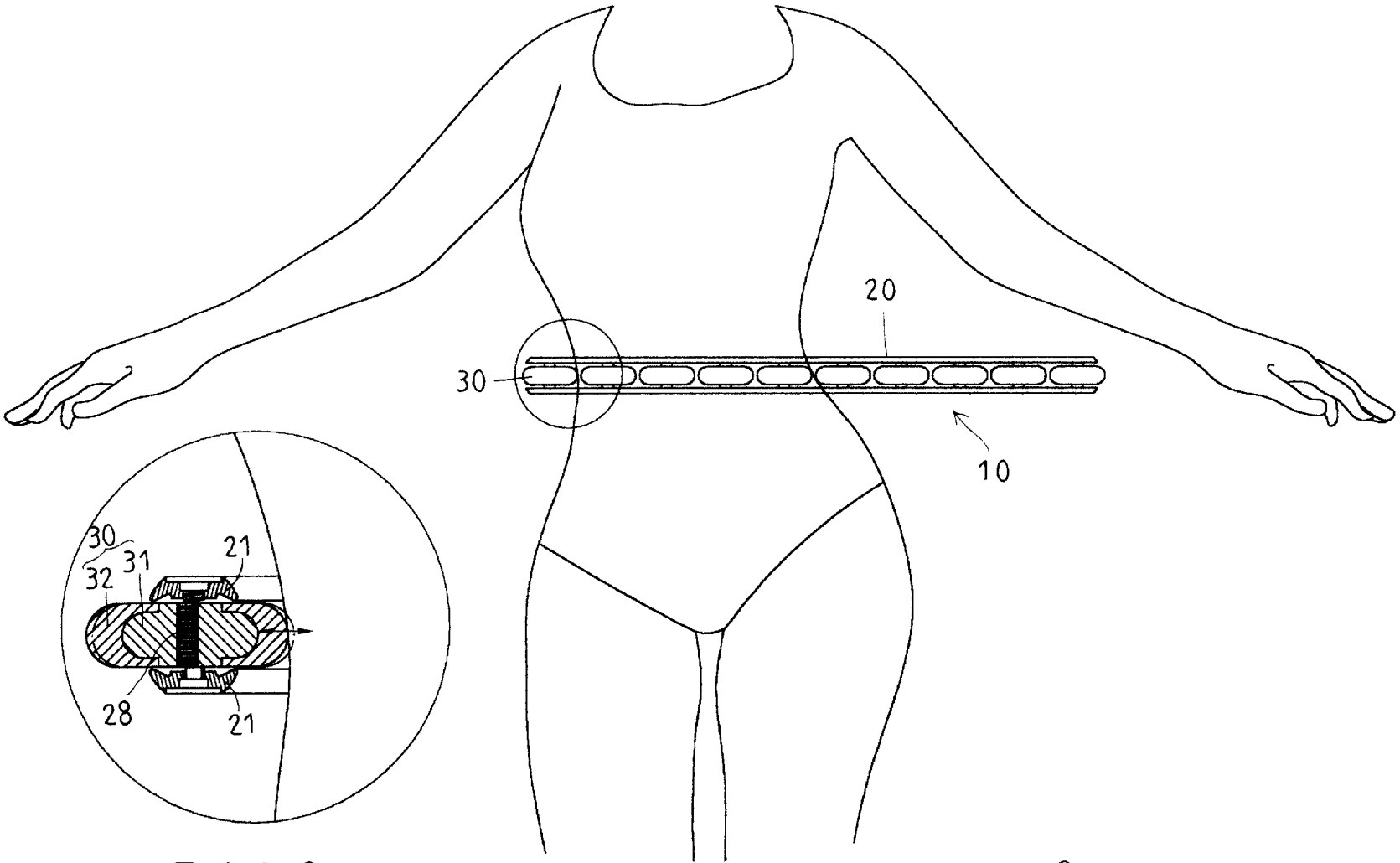
FIG. 6 is a schematic plan view of a foldable hula hoop structure in accordance with another embodiment of the present invention.
FIG. 6A is a partially cut-away cross-sectional view of the foldable hula hoop structure as shown in FIG. 6.

Referring to FIGS. 6 and 6A, in accordance with another embodiment of the present invention, an elastic member 28 is mounted in the central portion 31 of each of the multiple wheel-shaped rollers 30, and is biased between the two main bodies 21. Thus, the pivot portion 26 of the main body 21 is undefined.

Figure 7B:
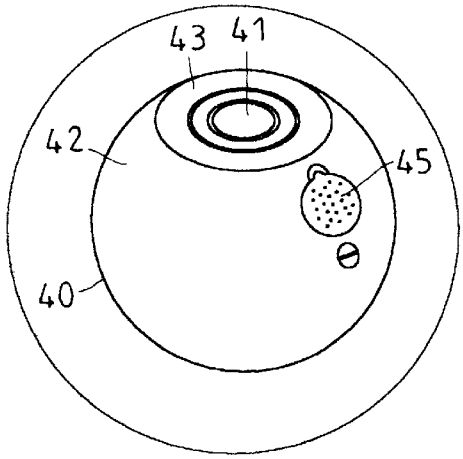
FIG. 7B is a perspective view of a spherical roller of the foldable hula hoop structure as shown in FIG. 7.
Figures 7, 7A:
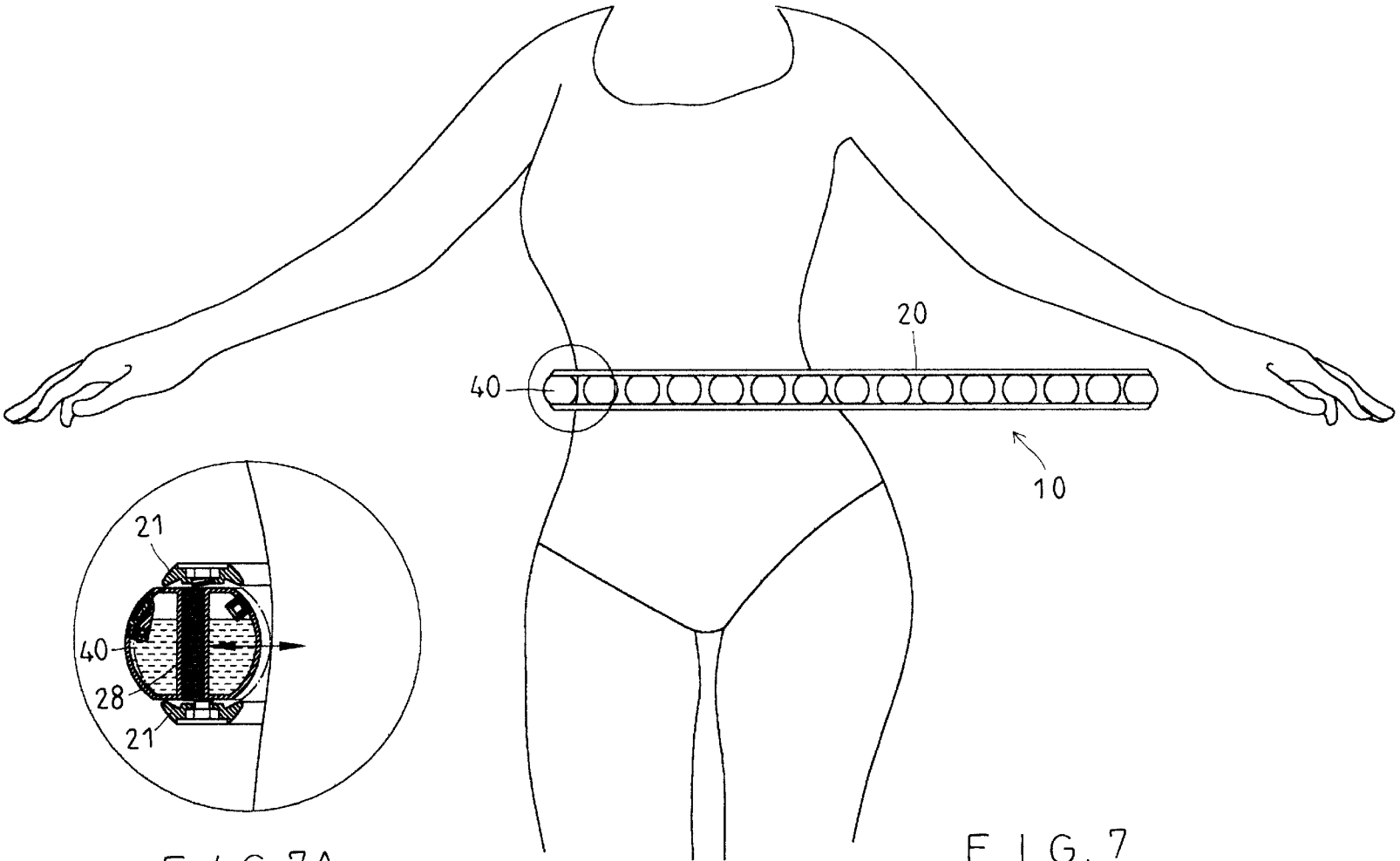
FIG. 7 is a schematic plan view of a foldable hula hoop structure in accordance with a first embodiment of the present invention.
FIG. 7A is a partially cut-away cross-sectional view of the foldable hula hoop structure as shown in FIG. 7.

Referring to FIG. 7, a foldable hula hoop structure 10 in accordance with a second embodiment of the present invention is shown.

As shown in FIGS. 7A and 7B, each of the multiple spherical rollers 40 is made of a composite material, and includes a central portion 41 made of a harder material, and a peripheral portion 42 made of a softer material mounted around the central portion 41, thereby providing a softer feature to the human body when in contact with the user's body. The peripheral portion 42 of each of the multiple spherical rollers 40 has two opposite sides formed with two planes 43. An elastic member 28 is mounted in the central portion 41 of each of the multiple spherical rollers 40, and is biased between the two main bodies 21. Thus, the pivot portion 26 of the main body 21 is undefined.

As shown in FIG. 8, a foldable hula hoop structure in accordance with another embodiment of the present invention is shown, wherein the multiple spherical rollers 40 have different sizes, thereby providing different massaging effects.

Figure 9:
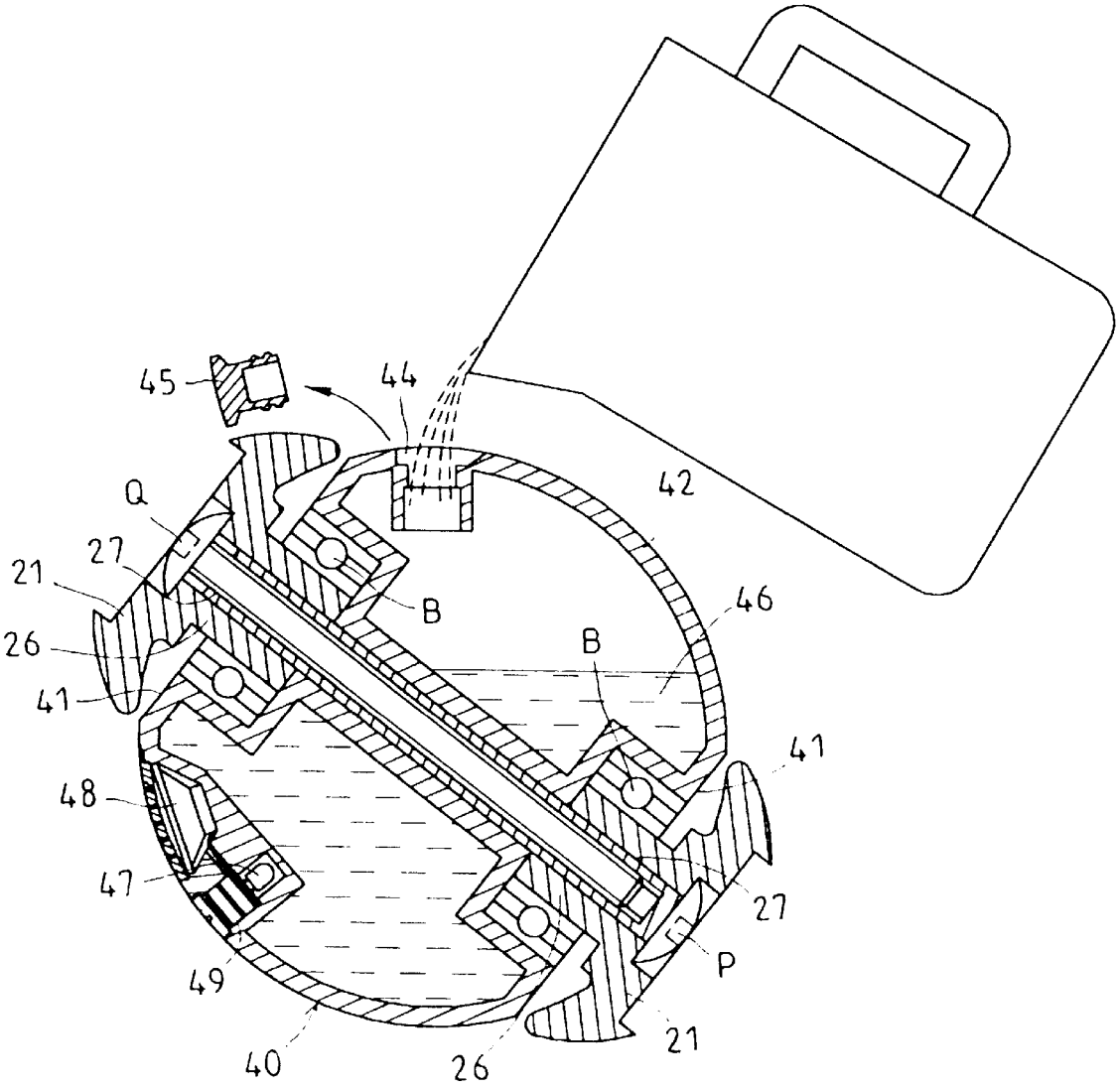
FIG. 9 is a cross-sectional view of a spherical roller of the foldable hula hoop structure in accordance with another embodiment of the present invention.

Referring to FIG. 9, in accordance with another embodiment of the present invention, the peripheral portion 42 of each of the multiple spherical rollers 40 has a periphery formed with a filling port 44 and provided with a plug 45, so that water or other filler may be filled into the filling port 44 when the plug 45 is removed from the filling port 44.

Each of the multiple spherical rollers 40 has an inside provided with luminous plates 46, and has a periphery provided with a light emitting member 47, a buzzer 48, and a battery 49. Thus, when the foldable hula hoop structure 10 of the present invention is turned, the light emitting member 47 will light and the buzzer 48 will buzz, thereby providing an amusement effect.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A foldable hula hoop structure, comprising multiple arcuate connecting members combined with each other, wherein:

each of the arcuate connecting members includes two opposite flexible main bodies combined with each other, each of the two opposite main bodies has a first end and a second end respectively provided with convex portions and mating concave portions, so that any two adjacent arcuate connecting members is combined with each other by engagement of the convex portions with the mating concave portions, each of the convex portions and the mating concave portions is formed with a through hole for passage of a first locking member which is locked with a second locking member, so that any two adjacent arcuate connecting members is pivotally combined with each other by the first locking member and the second locking member;

the foldable hula hoop structure further comprises an elastic restoring member mounted on the first locking member and the second locking member and urged between each of the convex portions and the mating concave portion, so that when the first locking member is unlocked from the second locking member, each of the two opposite main bodies is pushed outward by a restoring force of the elastic restoring member, and each of the convex portions is detached from the mating concave portion; and when the first locking member is unlocked from the second locking member, any two adjacent arcuate connecting members is pivoted with each other, so that the multiple arcuate connecting members is pivoted and folded so as to fold the foldable hula hoop structure.

2. The foldable hula hoop structure in accordance with claim 1, wherein each of the two opposite main bodies is provided with multiple pivot portions for pivoting multiple rollers, each of the pivot portions is formed with a pivot hole for passage of a third locking member which is locked with a fourth locking member, so that the multiple rollers is pivotally mounted between the opposite main bodies.

3. The foldable hula hoop structure in accordance with claim 2, herein the rollers are wheel-shaped rollers.

4. The foldable hula hoop structure in accordance with claim 2, further comprising multiple bearings each mounted between each of the pivot portions and each of the multiple rollers.

5. The foldable hula hoop structure in accordance with claim 2, wherein each of the rollers is made of a composite material, and includes a central portion made of a harder material, and a peripheral portion made of a softer material mounted around the central portion.

6. The foldable hula hoop structure in accordance with claim 5, further comprising an elastic member mounted in the central portion of each of the multiple rollers, and biased between the two main bodies.

7. The foldable hula hoop structure in accordance with claim 5, wherein the peripheral portion of each of the multiple rollers has two opposite sides formed with two planes.

8. The foldable hula hoop structure in accordance with claim 2, wherein the rollers are spherical rollers.

9. The foldable hula hoop structure in accordance with claim 8, wherein the multiple spherical rollers have different sizes.

10. The foldable hula hoop structure in accordance with claim 8, wherein the peripheral portion of each of the multiple spherical rollers has a periphery formed with a filling port and provided with a plug, so that water or other filler is filled into the filling port when the plug is removed from the filling port.

* * * * *